US005562501A

United States Patent [19]

Kinoshita et al.

[11] Patent Number: 5,562,501

[45] Date of Patent: Oct. 8, 1996

[54] FEMALE ELECTRICAL CONTACT WITH STOP FOR RESILIENT CONTACT

[75] Inventors: Yoshiji Kinoshita; Hiroshi Kitamura, both of Kawasaki, Japan

[73] Assignee: The Whitaker Corporation, Wilmington, Del.

[21] Appl. No.: 342,189

[22] Filed: Nov. 18, 1994

[30] Foreign Application Priority Data

Nov. 30, 1993 [JP] Japan ..... 5-064050 U

[51] Int. Cl.[6] ..... H01R 11/22

[52] U.S. Cl. ..... 439/852; 439/851

[58] Field of Search ..... 439/842, 843, 439/851–856, 861, 862, 839, 849, 850

[56] References Cited

U.S. PATENT DOCUMENTS

| | | | |
|---|---|---|---|
| 4,560,231 | 12/1985 | Shirai | 439/851 |
| 5,217,382 | 6/1993 | Sparks | 439/843 |
| 5,226,842 | 7/1993 | Endo et al. | 439/843 |
| 5,433,629 | 7/1995 | Yagi et al. | 439/843 |
| 5,441,428 | 8/1995 | Hamai et al. | 439/843 |

FOREIGN PATENT DOCUMENTS

| | | |
|---|---|---|
| 58-62564 | 4/1983 | Japan . |
| 62-20144 | 5/1987 | Japan . |

*Primary Examiner*—David L. Pirlot

[57] ABSTRACT

An electrical contact 1 is disclosed which eliminates the possibility of harmful deformations in a bent section of a resilient contacting strip 5 which is bent back from the front portion of a base section 2 of a female contact, even if it experiences a direct impact from a foreign object. Cut-outs 8 are made in the left and fight side walls 3 rising from the sides of the base section 2 of the female contact 1. On the left and right sides of the resilient contacting strip 5, in the vicinity of the bent section 53, protrusions 9 are made which face the left and right side walls 3. The spacing between the cut-outs 8 and protrusions 9 is selected in such a way that they make possible the movement of the resilient contacting strip 5 within allowed limits, but prevent any movement of the protrusions 9 beyond the permitted distance and direction when a foreign object makes a direct impact to the bent section 53.

19 Claims, 1 Drawing Sheet

FEMALE ELECTRICAL CONTACT WITH STOP FOR RESILIENT CONTACT

BACKGROUND OF THE INVENTION

1. Field of the Invention

This invention relates to female electrical contacts having a resilient contacting strip for the purpose of maintaining reliable connection with matching male electrical contacts.

2. Description of the Prior Art

Female electrical contacts having a resilient contacting strip for the purpose of maintaining reliable connection with matching male electrical contacts are known, for example, female contacts described in Japanese UM Publication Nos. 1987-20144 and 1983-62564. Since the resilient contacting strip of this type is bent at the from end of the female contact and the male contact is inserted well inside toward the back end, the bent section of the resilient contacting strip should have sufficient resiliency in order to maintain reliable connection with the male contact.

When a male contact is inserted in a female contact having such a resilient contacting strip not straight but at an angle, there is danger that the tip of the male contact will exert downward pressure on the resilient contacting strip and will deform it more than it is necessary, which can result in the loss of the initial resilience of the resilient contacting strip. In order to prevent such downward deformation of the contacts previously cited, protrusions are provided which come in contact with the free end of the resilient contacting strip and restrict the downward movement over a predetermined amount when a male contact is inserted.

SUMMARY OF THE INVENTION

The protrusions used in the female contacts according to the above mentioned disclosures are effective in restricting the deviation of the free end of the resilient contacting strip to predetermined limits when the male contact is inserted at an angle, however the protrusions used in the conventional female contacts could not prevent the bent section of the resilient contacting strip from deformation when a male contact is inserted in the female contact at an especially large angle. This bent section of the resilient contacting strip can be easily deformed not only at the time of insertion of a male contact, but also during transportation, assembly of the contact or any other impact directly to the bent section.

This invention is made taking into consideration the above information, and its purpose is to offer a female contact in which the bent section of the resilient contacting strip does not suffer harmful deformation upon a direct impact by some object.

In order to achieve the above stated purposes, the female contact according to this invention includes a base section extending from the front to the back thereof, side walls rising up from the left and right sides of the base section and a resilient contacting strip bent backwards from a front end of the base section, and the resilient contacting strip has a protrusion in the vicinity of a bent section extending in the direction of the side walls, and that a cut-out is provided in at least one of the side walls allowing for play of the protrusion within predetermined limits and in a predetermined direction therein.

The above expression "play" means the regular deformation of the bent section taking place at the time of insertion of a male contact into the female contact limited by travel of the protrusion in the cutout The above expression "predetermined direction" means that among all possible directions which may result in unreasonable deformation, for example: back, forward, up or down relative to the female contact, only specific directions are considered.

Thanks to protrusions made on the resilient contacting strip in the vicinity of the bent section which can move within the cut-outs made in at least one side wall of the female contact according to this invention, harmful deformation of the bent section can be avoided when a male contact is inserted in the female contact even if its tip comes directly against the bent section or if the bent section experiences an impact from a foreign object during handling.

BRIEF DESCRIPTION OF THE DRAWINGS

An embodiment of the invention will now be described by way of example with reference to the accompanying drawing.

DETAILED DESCRIPTION OF THE INVENTION

Figure 1:
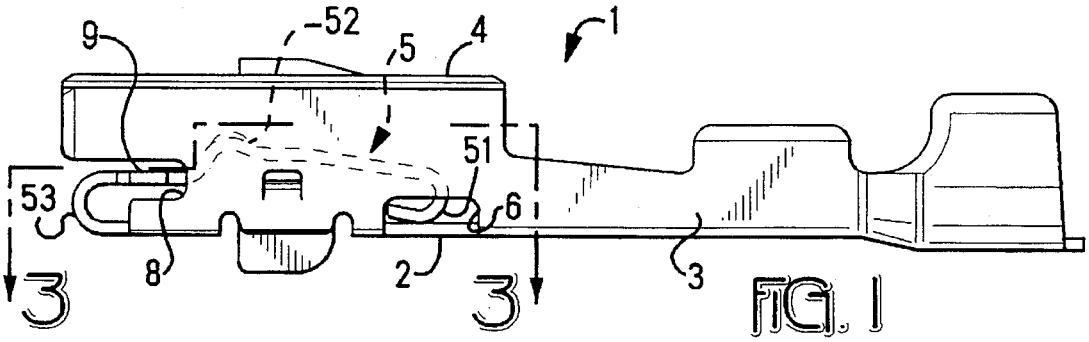
FIG. 1 is a side view of an embodiment of the female contact according to this invention.
Figure 2:
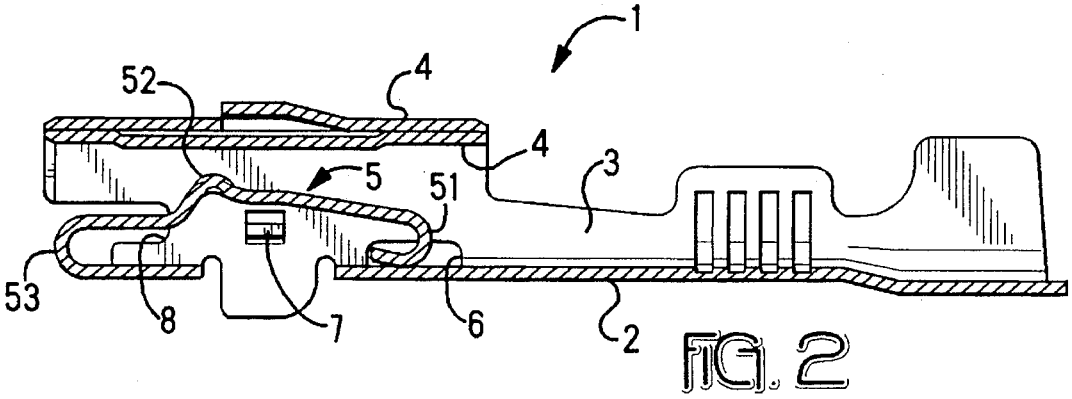
FIG. 2 is a longitudinal cross-sectional view of the female contact shown in the FIG. 1.

The female contact 1 depicted in the drawings is of the box type and it comprises a base section 2 extending lengthwise (see FIG. 2), right and left side walls 3 rising from the right and left edges of the base section 2 (see FIG. 3) and an upper wall 4 formed from the upper edges of the side walls 3 which extends parallel to the base section 2 (see FIG. 2).

A resilient contacting strip 5 is bent from the front tip of the base section 2; it extends to the back and inside of the contact 1. The free end 51 of the resilient contacting strip 5 is bent toward the front end of the contact; it is desirable that its lower portion be in contact with the base section 2. In the side walls 3, near the location of the free end 51 of the resilient contacting strip 5, sight holes 6 are provided through which a person can see that the free end 51 is in its correct position.

The contacting section 52 of the resilient contacting strip 5 is strongly arched upward in order to make a good contact with the male contact (not shown in the drawing) inserted in the female contact 1. Due to the fact that the contacting section 52 is arched, the entire length of the resilient contacting strip 5 becomes longer which improves the strain dissipation generated in the resilient contacting strip 5. In addition, projections 7 are punched from the side walls 3 and bent inside the contact at a location near the middle of the resilient contacting strip 5. These projections 7 are situated under the resilient contacting strip 5 and they prevent the displacement of the midsection of the resilient contacting strip 5 beyond the predetermined limits when it is pushed by the tip of a male contact inserted in the female contact 1 at an angle. That is, the function of these projections is to prevent the loss of resiliency of the resilient contacting strip 5.

Figure 3:
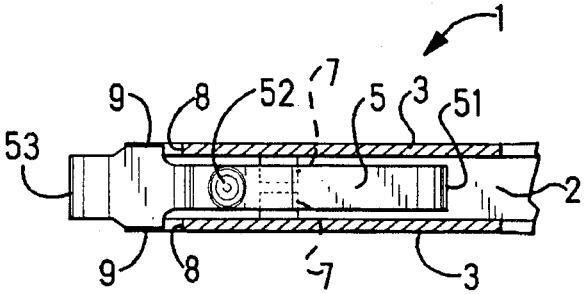
FIG. 3 is a cross section taken along line 3—3 in FIG. 1.

At the front ends of the side walls 3, there are cut-outs 8 which extend toward the back of the contact. On the other hand, as shown in FIG. 3, the resilient contacting strip 5 has in the vicinity of its bent section 53 protrusions 9 which are disposed in cut-outs 8 and can move up and down there-within thereby limiting the play thereof. The spacing between these cut outs 8 made in the side walls and the protrusions 9 made on the left and right side of resilient contacting strip 5 is such that they allow for the proper movement of the resilient contacting strip 5 when a male contact is properly inserted in the female contact 1. At the same time, if the male contact is inserted directly against the bent section 53 of the resilient contacting strip 5 or if a force is applied acting down and back, the cut-outs 8 and the protrusions 9 prevent the movement of the bent section 53 beyond the allowable limits. Since the movement of the protrusions 9 is restricted by the cut-outs 8, the bent section 53 will not suffer harmful deformation if a foreign object produces an impact to the bent section 53. If a male contact is inserted obliquely in the female contact 1, projections 7 will come in contact with the midsection of the resilient contacting strip 5 and will prevent its movement beyond allowable limits; at the same time, the protrusions 9 will come in contact with the upper edges of the cut-outs 8 and will prevent downward movement of the bent section 53 of the resilient contacting strip 5 beyond allowable limits. As a result, deformation of the resilient contacting strip 5 will not exceed the limits of elastic deformation along its entire length.

Explanations have therefore been set forth above concerning an embodiment of a female contact according to this invention; however, invention is not limited to this specific configurations, but also comprises various modifications.

For example, the cut-outs provided at the front ends of the side walls of the female contact are made in the form of grooves, but they also can be made in the form of closed holes completely surrounding the protrusions.

In addition, in the embodiment described above, cut-outs and protrusions are made respectively in the left and right walls and on the left and right sides of the resilient contacting strip; however, there may be only one protrusion and only one cut-out made at one side of the contact at a matching location.

It is also possible to make protrusions in the walls, and the cut-outs in the resilient contacting strip.

In addition, the female contact in the form of the above mentioned embodiment is of a box type comprising a base section, left and right walls and an upper wall; however, it is needless to say that this invention is applicable as well to female contacts without the upper wall.

We claim:

1. A female electrical contact for electrically engaging a male electrical contact, the female contact comprising a base section with side walls extending upwardly from both sides of said base section, and a resilient contacting strip extending rearward from the front of said base section and having a bent section integral with the front of said base section, said resilient contacting strip comprises an extension of said base section for making electrical contact with a male contact inserted into said female contact along the upper surface of said resilient contacting strip, said female electrical contact being characterized by:

at least one protrusion extending between said resilient contacting strip and an adjacent side wall, said protrusion engaging a surface located below said resilient contacting surface upper surface to prevent deflection of said resilient contacting strip beyond the limit of elastic deformation and at least one protrusion extends from said resilient contact strip through a cut-out, the lower edge of said cut-out comprising said surface located below said resilient contacting strip upper surface.

2. The female contact of claim 1 wherein the free end of said resilient contacting strip is in contact with said base section prior to insertion of said male contact into engagement with said female contact.

3. The female contact of claim 1 wherein said cut out includes an upper edge, said protrusion engaging said upper edge before deflection of said resilient contacting strip in the opposite direction beyond the limit of elastic deformation.

4. The female contact of claim 1 wherein said protrusion and said surface located below said resilient contacting strip upper surface are located in the vicinity of said bent section adjacent the front of said resilient contacting strip and the front of said base section.

5. The female contact of claim 1 wherein said protrusion extends from said side wall and said surface below said resilient contacting strip upper surface comprises said resilient contacting strip lower surface.

6. The female contact of claim 1 wherein a first protrusion extends from said resilient contacting strip through a cut-out in said side wall adjacent the front of said resilient contacting strip and a second protrusion, adjacent the midsection of said resilient contact strip, is punched inwardly from said at least one of said side walls to form a projection below said resilient contacting strip.

7. A female electrical contact for electrically engaging a male electrical contact, the female contact comprising a base section with side walls extending upwardly from both sides of said base section, and a resilient contacting strip extending rearward from the front of said base section and having a bent section adjacent the front of said base section, said resilient contacting strip extending upward relative to said base section to make electrical contact with a male contact inserted into said female contact along the upper surface of said resilient contacting strip, said female electrical contact being characterized by:

at least one protrusion extending between said resilient contacting strip and an adjacent side wall, said protrusion engaging a surface located below said resilient contacting surface upper surface to prevent deflection of said resilient contacting strip beyond the limit of elastic deformation; and a first protrusion extends from said resilient contacting strip through a cut-out in said side wall adjacent the front of said resilient contacting strip and a second protrusion, adjacent the midsection of said resilient contact strip, is punched inwardly from said at least one of said side walls to form a projection below said resilient contacting strip.

8. A receptacle contact for use in an electrical system, said contact comprising:

a receptacle section having a cavity for receiving a further contact therein;

a deflectable beam disposed in said cavity, said beam comprises a pair of spring means located at opposed locations of said beam for generating biasing forces at the opposed locations of said beam as said further contact is inserted in said cavity and engages said beam, at least one of said spring means is integral with said receptacle section.

9. The receptacle contact of claim 8, wherein said pair of spring means comprises a pair of opposed arcuate bends formed in said beam for generating said biasing forces.

10. The receptacle contact of claim 8, wherein said beam comprises an offset section axially between said spring means.

11. The receptacle contact of claim 8, wherein one of said spring means is disposed for sliding contact with a surface of said cavity as said further contact is inserted into said cavity.

12. The receptacle contact of claim 8, wherein said beam comprises an anti-stubbing section and a deflection limiting section which both engage said receptacle section.

13. The receptacle contact of claim 8, wherein said receptacle section includes a mating face, said mating face includes an anti-stubbing section for engaging an anti-stubbing section on said beam for regulating movement of said beam in said cavity.

14. The receptacle contact of claim 8, wherein said beam comprises two axially separate beam deflection-limiting sections between said spring means for limiting movement of said beam in said cavity at axially separate locations along said cavity.

15. The receptacle contact of claim 14, wherein one of said sections comprises a projection.

16. The receptacle contact of claim 14, wherein one of said sections comprises a projection formed on said receptacle section.

17. A receptacle contact for use in an electrical system, said contact comprising:

a receptacle section having a cavity for receiving a further contact therein;

a deflectable beam disposed in said cavity, said beam comprises spring means for generating biasing forces as said further contact is inserted in said cavity and engages said beam; and said receptacle section includes a mating face end, said mating face includes at least one anti-stubbing section which cooperates with an anti-stubbing section of said beam for delimiting the movement of a portion of said beam in said cavity in cooperation with said spring means for preventing contact stubbing.

18. The receptacle contact of claim 17, wherein said receptacle anti-stubbing section comprises a recess.

19. The receptacle contact of claim 17, wherein said beam anti-stubbing section comprises a projection.

* * * * *